United States Patent [19]

Rammesten

[11] 4,428,220

[45] Jan. 31, 1984

[54] METHOD AND TOOL FOR THE COLD FORGING OF INTERNALLY PROFILED TUBES

[75] Inventor: Ivan Oskar Rammesten, Eskilstuna, Sweden

[73] Assignee: Forenade Fabriksverken, Eskilstuna, Sweden

[21] Appl. No.: 341,660

[22] Filed: Jan. 22, 1982

[30] Foreign Application Priority Data

Feb. 3, 1981 [SE] Sweden ..... 8100771

[51] Int. Cl.[3] ..... B21B 17/02

[52] U.S. Cl. ..... 72/370; 72/398; 72/283; 72/401

[58] Field of Search ..... 72/76, 370, 402, 398, 72/401, 139, 208, 283

[56] References Cited

U.S. PATENT DOCUMENTS

| | | | |
|---|---|---|---|
| 3,292,408 | 12/1966 | Hill | 72/283 |
| 3,327,513 | 6/1967 | Hinshaw | 72/283 |
| 3,753,365 | 8/1973 | Kralowetz | 72/76 |
| 4,154,082 | 5/1979 | Beech | 72/370 |
| 4,270,690 | 6/1981 | Mabery et al. | 72/370 |

*Primary Examiner*—Francis S. Husar

*Assistant Examiner*—David B. Jones

*Attorney, Agent, or Firm*—James E. Nilles

[57] ABSTRACT

A method and tool for cold forging or cold hammering of internally profiled tubes, whereby a forging blank (2) is while rotated, forged by the action of a number of forging hammers (4), whereby the workpiece (2) as a result of material displacement is formed around a profiling mandrel (3). Before cold forging, the mandrel (3) is adjusted with its axial center (c—c) to a position axially to the side of the forging blank's (2) axial center (c'—c') at a distance equal to half the rolled billets extension during cold forging, and in the direction away from the forging hammers' start position. The apparatus comprises an end socket (5) and a driver (10) between which both the workpiece (2) and mandrel (3) are arranged to be clamped. The end socket (5), which is positioned at the forging hammers (4) starting side, is arranged to include varying thicknesses of end positioners (9) for adjusting the mandrel (3) position, and at the other end of the mandrel is a device for forcing the mandrel against the end socket (5). This spring device is active between a ram (14) and driver (10), which in turn is axially displaceable against the action of a pre-determined pressure.

5 Claims, 4 Drawing Figures

METHOD AND TOOL FOR THE COLD FORGING OF INTERNALLY PROFILED TUBES

The present invention concerns a method and a tool for the cold forging of internally profiled tubes and cylinders etc. Profiled means, in this case, any profiled form such as axial grooves or splines, various kinds of threads, threads combined with radial grooves etc. Internal profiles in tubes or cylinders have earlier been produced by cutting methods such as turning, shaping, slotting etc. The production of internal profiles in tubes and cylinders etc. has of late even been accomplished by cold forging, whereby a tube or cylinder is forged around a mandrel, which after the process is removed from the tube or cylinder.

Cold forging involves several advantages compared to cutting methods. By cold forging a finer surface finish can be achieved than with cutting methods, the material is harder as a result of the fact that no material fibers are cut off, internal stresses from earlier handling are removed, the profiles can be formed to extremely fine tolerances, the cold forged products are produced with an even and high quality etc.

Cold forging around a mandrel is however subject to some problems. As cold forging is normally effected by a progressive working of the tube or cylinder from one end to the other by use of forging hammers, the workpiece will usually be lengthened by cold forging. The increase in length can be considerable in cases where the tube or cylinder is formed with extensive internal profiles such as threads, splines etc. When forming the mandrel and tube or cylinder workpiece, consideration must therefore be taken to this increase in length. The workpiece and mandrel must therefore be so calculated in relation to one another that the axial centre for the mandrel after forging coincides with the tube's or cylinder's axial centre. When setting up the mandrel and tubular workpiece for forging, the mandrel is therefore positioned with its axial centre at some distance axially from the axial centre of the tubular workpiece, more particularly at a distance therefrom, in the direction away from the forging hammers— starting end, that is equal to half the tubular workpiece's calculated elongation.

Further, the mandrel and tubular workpiece are set up in such a way that the ends nearest the starting position the forging hammers are rigidly fixed, while the opposite end of the tubular workpiece is mounted to be axially displaceable against the pressure of a suitable axial loading.

When using axially parted mandrels the spring loaded side is positioned furthest from the forging hammers so that it has some possibility of moving during the forging process.

DESCRIPTION OF THE DRAWINGS

The invention shall now be described in detail with reference to the accompanying drawings of an example.

DESCRIPTION OF THE INVENTION

Figure 1:
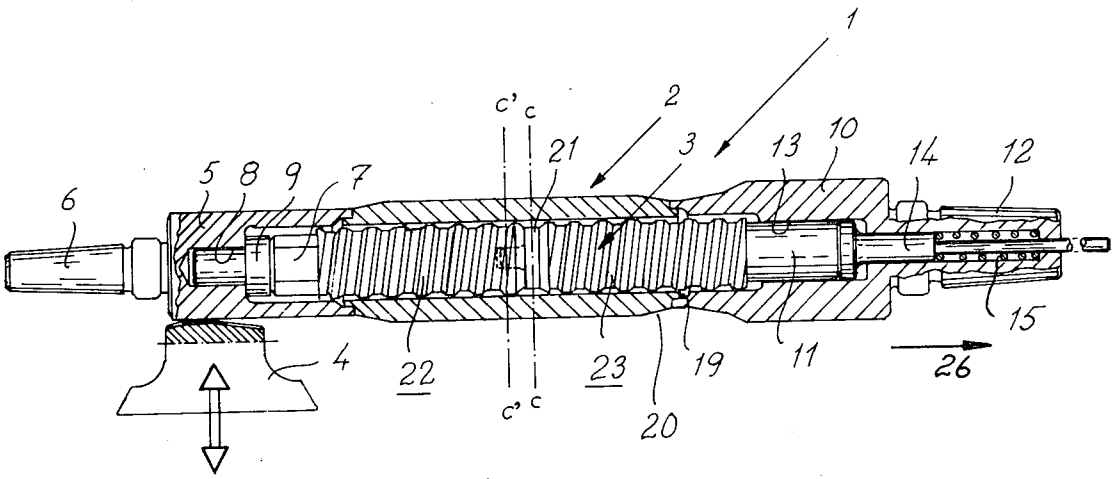
FIG. 1 diagrammatically shows parts of a machine for cold forging of a threaded cylinder with a centrally positioned rib.

The machine shown in FIG. 1 for cold forging or cold hammering of an internal profile in a cylindrical workpiece comprises a forging tool 1, in which a rolled billet 2 and a mandrel 3 can be set up, and which is arranged to be rotated. The apparatus further includes four forging hammers 4, which are oriented at 90° angles to each other around the tool and workpiece. The tool and workpiece are axially displaceable between and past the forging hammers. The hammers are driven by eccentrics, not shown, for the cold forging or cold hammering of the workpiece 2, so that the workpiece is formed around the mandrel 3 while its outside form is given a practically even surface.

The tool comprises an end socket 5 which by a journal 6 is carried in a ball bearing, and which is internally arranged to accept the one end 7 of the mandrel 3. To enable an exact axial positioning of the mandrel, the end socket 5 is formed with an axial hole 8 on its inside, in which a cylindrically formed end positioner 9 can be adapted. The end positioner 9 is shaped with a collar, the axial length of which determines the mandrel's position.

The other end of the forging tool 1 forms a driver 10 in which the other end 11 of the mandrel is mounted. Between the end socket 5 and driver 10 the workpiece 2 is clamped by the driver 10 being pressed towards the rigidly fixed end socket 5. The driver 10 comprises a shaft end 12 for coupling to a motor which turns the tool and workpiece during the cold forging process. The mandrel 3 is displaceable in an axial hole 13 in the driver 10 and for loading the mandrel towards the axially fixed end socket 5, a ram 14 is arranged with a spring 15. The end socket 5 and driver 10 can on their opposing faces be formed with sharp edges which hold the workpiece in a steady grip during the cold forging, which proceeds as the tool and workpiece rotate.

Figure 3:
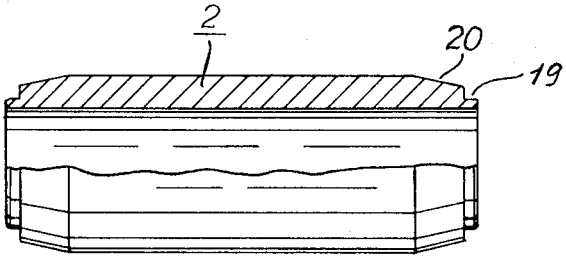
FIG. 3 shows a forging workpiece for a joining sleeve for drilling rods, partly cut away.
Figure 4:
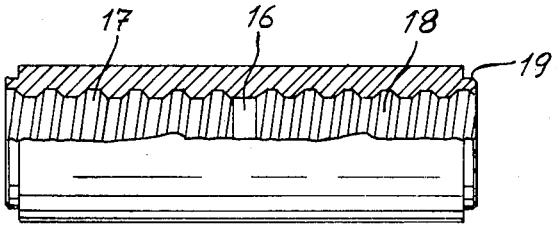
FIG. 4 shows in a similar manner the workpiece shown in FIG. 3 after being forged around the mandrel.

With the described apparatus, many different shapes, types and sizes of internal profiling of a tube or cylinder can be achieved, but as an example here is shown the production of a joining sleeve for drilling rods. As is most clearly shown in FIG. 4, the joining sleeve is formed with a centrally positioned internal rib 16 on each side of which are threads 17 and 18. The function of the rib 16 is to prevent any of the drilling rods from being in further than the axial center, which could cause varying problems. The rib 16 therefore is entirely radial and also has to some extent a lesser diameter than the tops of the threads 17 and 18. During cold forging the material becomes reconfigured from the cylindrical form shown in FIG. 3, and therefore the cylindrical workpiece is initially given a larger diameter than the required final diameter. At each end the workpiece is formed with a narrow axially projecting ring 19 for centering and clamping the workpiece in the end socket 5 and driver 10 and from said rings 19 the workpiece is shaped with diverging cones 20. While cold forging the workpiece a successively increasing material displacement is achieved from the starting cone, so that the joining sleeve is internally formed with a complementary coned start to the thread 17 and 18. This feature simplifies the screwing in of the drilling rods.

Figure 2:
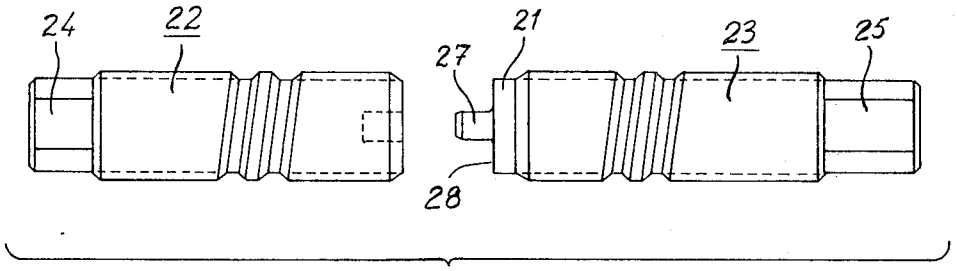
FIG. 2 shows a mandrel used in conjunction with the apparatus according to FIG. 1.

To make it possible to remove the mandrel from the forged joining sleeve, the mandrel must be parted, otherwise the radial rib 16 would prevent such a removal. As is shown in FIG. 2 the parting of the mandrel has been made at one side of the radial groove 21 that produces the rib 16. This makes it possible to withdraw each half 22 and 23 of the mandrel from each end of the formed joining sleeve. To make such a withdrawal possible the ends of the mandrel can be furnished with hexagonal ends 24, 25 to which a spanner can be applied.

As is mentioned earlier, the workpiece is subjected to an elongation during the process of cold forging. The tool is displaced to the left in FIG. 1 between the forging hammers 4 during the cold forging of the workpiece 2 and this means that the material in the workpiece is stretched to the right. Under the force of spring loaded ram 14 the mandrel's right hand part 23 remains in constant contact with left hand part 22. The halves of the mandrel can be loosely connected to each other with the help of a dowel hole guide 27, which can be formed with some play. As a result of the material displacement in the workpiece during cold forging, the mandrel must be parted next to the radial groove 21 on its extension side, that is at the left edge 28 of the radial groove 21 as is shown on the drawing.

The material displacement which occurs during cold forging is thus only in one direction, and to ensure that the radial rib 16 is axially centered in the joining sleeve, the centre c—c of the mandrel is placed somewhat to the side of the axial centre c'—c' of the work piece. Adjustment of the mandrel's position relative to the workpiece is easily achieved by using different end positioners 9. It is important that the ram presses the right part 23 of the mandrel against the left part 22 until hammering has extended past the radial groove 21 and at least to some extent into the right hand threads 18. The two parts of the mandrel then remain in a state of connection by the workpiece.

After cold forging of the workpiece, the tool returns with the forged workpiece back to its start position as shown in FIG. 1. The driver 10 is removed and the joining sleeve together with the mandrel halves is removed. By forming the threads of the mandrel to be slightly convergent towards the radial groove, and preferably also forming the mandrel's thread flanks so that a release is attained, that is, that the thread width of the mandrel is thinnest at the workpiece's axial centre, the halves can relatively easily be withdrawn from the joining sleeve. Normally, only a few heavy blows against the thread direction is needed to enable the mandrel to release, whereby the mandrel can easily be screwed out.

It is understood that the above description and the embodiment of the invention shown on the drawings is only an example and many modifications within the frame of the following claims can be envisaged.

I claim:

1. Apparatus for cold forging a tubular blank to form the same into a tubular article having a predetermined internal configuration, said apparatus comprising opposite forging hammers driven for repeated radially inward impacting against a blank that is supported between them and is constrained to rotation and axial motion in one direction relative to the hammers so that the hammers progress relatively along the blank from one to the other of its end portions, said apparatus being characterized by:

A. a mandrel coaxially receivable in the blank and having a form defining portion with a length substantially equal to that of the article to be formed and with an external configuration that is the mating counterpart of said internal configuration;

B. gripping means engageable with said one end portion of the blank and with the corresponding end portion of said mandrel to confine those end portions against axial displacement relative to one another, said gripping means being arranged to provide for axial movement of the blank and the mandrel relative to the forging hammers;

C. clamping means for engaging said other end portion of the blank and applying to it a yielding axial biasing force whereby its said one end is maintained in engagement with the gripping means and its said other end is permitted to move axially away from the gripping means as the blank is elongated by the action of the hammers; and D. mandrel confining means coaxially adjacent to said clamping means and engageable with the end portion of the mandrel that is remote from the gripping means to confine the mandrel against axial displacement relative to the gripping means.

2. The apparatus of claim 1, further characterized by: said mandrel confining means being arranged to impose axial yielding bias upon the mandrel in the direction towards the gripping means.

3. The apparatus of claim 1 wherein said form defining portion of the mandrel has a circumferential groove intermediate the ends thereof that defines a circumferential internal rib in the article, further characterized by:

said mandrel being formed in two coaxial parts which are axially separable at said groove so that said parts can be withdrawn from the article in opposite axial directions.

4. A process for cold forging a tubular blank to form it into a tubular article, comprising the steps of repeatedly impacting the blank with forging hammers that move in opposite radially inward directions relative to it, and constraining the blank to rotation and to axial motion in one direction relative to the forging hammers so that the hammers progress relative around the blank and along it from one to the other of its axial end portions, said process being characterized by:

A. coaxially inserting through the blank, before subjecting it to the forging hammers, a mandrel having a form defining portion which is at least as long as the article to be formed and which has an external configuration that defines the internal configuration of said article;

B. engaging said one end portion of the blank and the corresponding end portion of the mandrel against a common support to fix said one end portion of the blank and said corresponding end portion of the mandrel against axial displacement relative to one another, so that elongation of the blank during forging effects displacement of the blank along the mandrel only in said one direction;

C. by engaging the blank at its said other end portion, yieldingly biasing the blank oppositely to said direction so that the blank is maintained engaged with said common support as it is elongated under the action of the hammers; and D. by engaging the opposite end of the mandrel, confining it against axial displacement away from said common support as the blank is elongated.

5. The method of claim 4, further characterized by: so inserting the mandrel through the blank that the midpoint of said form defining portion of the mandrel is spaced in said direction from the midpoint of the blank by a distance equal to half the difference in length between the blank and the formed article.

* * * * *